US005337953A

United States Patent [19]

Haest

[11] Patent Number: 5,337,953

[45] Date of Patent: Aug. 16, 1994

[54] PLASTIC MAILBOX

[76] Inventor: Wilfried Haest, 1821 Peters Road, North Vancouver, B.C., Canada, V7J 1Y7

[21] Appl. No.: 5,718

[22] Filed: Jan. 10, 1993

[51] Int. Cl.[5] ..... B65D 91/00

[52] U.S. Cl. ..... 232/17; 232/24; 232/34; 232/43.2

[58] Field of Search ..... 232/1 C, 17, 24, 29, 232/30, 34, 38, 43.2, 45; 220/23.4

[56] References Cited

U.S. PATENT DOCUMENTS

| | | | |
|---|---|---|---|
| 636,947 | 11/1899 | Bishop | 232/30 |
| 693,770 | 2/1902 | Wright | 232/17 |
| 1,810,769 | 6/1931 | Jaden | 232/17 |
| 3,802,619 | 4/1974 | Vanderveer | 232/17 |
| 3,825,173 | 7/1974 | Sunday | 232/17 |
| 3,982,690 | 9/1976 | Krizan et al. | 232/17 |
| 4,333,603 | 6/1982 | Carlson | 232/17 |
| 4,361,271 | 11/1982 | Hester et al. | 232/17 |
| 4,372,480 | 2/1983 | Mitchell et al. | 232/17 X |
| 4,889,254 | 12/1989 | Vola | 220/23.4 |
| 5,050,755 | 9/1991 | Strawder | 220/23.4 |
| 5,054,862 | 10/1991 | Vanaman | 232/17 X |
| 5,083,703 | 1/1992 | Blyakharov | 232/17 |
| 5,119,986 | 6/1992 | Kobilarcik et al. | 232/17 X |
| 5,143,284 | 9/1992 | Socarras | 232/21 |

FOREIGN PATENT DOCUMENTS

| | | | |
|---|---|---|---|
| 674709 | 11/1963 | Canada | 232/17 |
| 1458546 | 10/1966 | France | 232/43.2 |
| 2615382 | 11/1988 | France | 232/17 |

*Primary Examiner*—Peter M. Cuomo
*Assistant Examiner*—Michael J. Milano
*Attorney, Agent, or Firm*—Townsend and Townsend Khourie and Crew

[57] ABSTRACT

A durable plastic mailbox for receiving mail has a removable inner container thus permitting the container to be removed from the exterior casing to empty the mail at another location. The mailbox has attachment grooves on one side and top that can engage with attachment ribs on the other side and bottom thus permitting a plurality of mailboxes to be stacked together. The mailbox has an exterior casing, substantially oblong in shape with an open front, and an inner container that fits within the exterior casing and is pivotable about internal protrusions from end walls of the casing, and is removable from the casing. A locking system retains the inner container in an upright position within the exterior casing.

12 Claims, 4 Drawing Sheets

PLASTIC MAILBOX

TECHNICAL FIELD

The present invention relates to a durable plastic mailbox and more specifically to a mailbox for receiving mail that has a removable inner container, and that can be joined to other mailboxes to form a multiple unit.

BACKGROUND ART

Mailboxes for receiving mail come in many different shapes and sizes. They are designed for outside use and, in many cases, are made out of metal. Multiple mailbox units are provided for apartment buildings and the like and for location in areas where a community has to collect mail. Multiple units generally have a fixed number of mailboxes, so this number is often either too few units or too many units. This is a disadvantage for a fixed number of mailboxes in a multiple unit. One example of a mailbox suitable for combining into a multiple unit is disclosed in U.S. Pat. No. 5,083,703 to Blyakharov.

It is an aim of the present invention to provide a mailbox for receiving mail that can be locked and that has a removable inner container so that mail can be carried in the container into a residence. It is also an aim of the present invention to provide a mailbox for receiving mail that can be combined with other mailboxes to form a multiple unit. Furthermore, it is an aim to have an infinitely variable number of mailboxes to form a multiple unit, and to provide the ability to add more mailboxes or remove mailboxes so the total number of mailboxes may be changed to suit the number of users.

A still further aim of the present invention is to provide a durable plastic mailbox to withstand all weather conditions, preferably made of molded plastic and in one embodiment having a flap so that mail can be inserted into the box without having to unlock it, the flap providing weather protection to prevent rain or snow from being blown into the inner container.

DISCLOSURE OF INVENTION

The present invention provides a plastic mailbox comprising in combination an exterior casing, substantially oblong in shape, having a top, a base, two end walls and a rear wall, the casing having a substantially rectangular shaped open front, connection means on the top, on the base and on the end wall for connection to at least one adjacent mailbox, an inner container fitting within the exterior casing, the inner container pivotable about internal protrusions from the end walls of the casing, and removable from the casing, and locking means to retain the inner container in an upright position within the exterior casing.

BRIEF DESCRIPTION OF DRAWINGS

In drawings which illustrate embodiments of the present invention.

MODES FOR CARRYING OUT THE INVENTION

Figure 1:
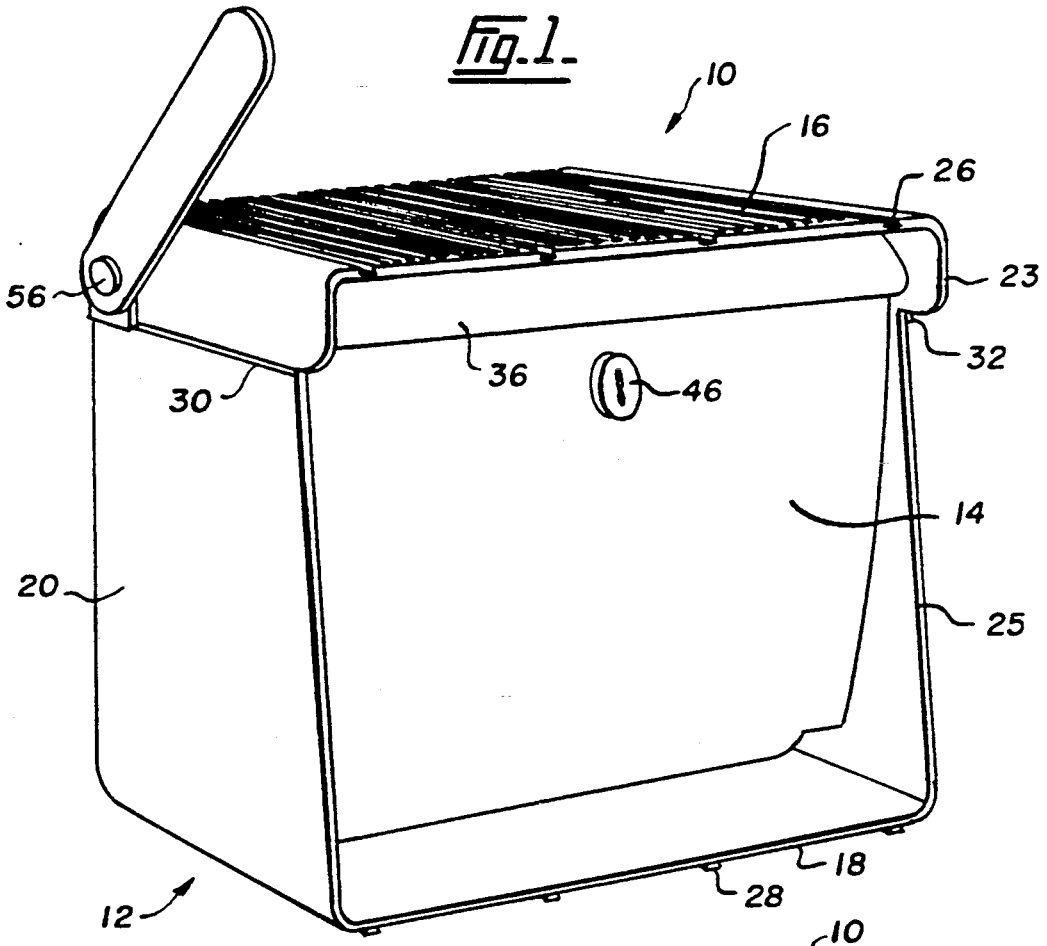
FIG. 1 is an isometric view showing one embodiment of a plastic mailbox according to the present invention.
Figure 2:
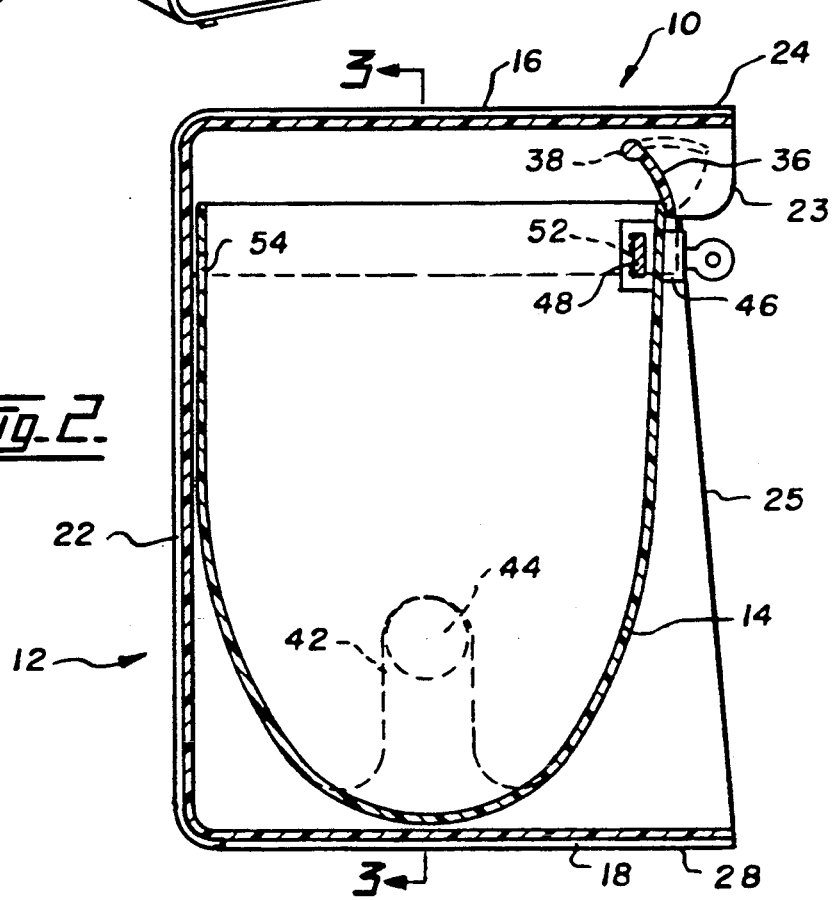
FIG. 2 a cross-sectional view through the mailbox shown in FIG. 1.

Referring now to FIGS. 1 to 4, a plastic mailbox 10 is shown having an exterior casing 12 and an inner container 14. The exterior casing 12 has a top 16 substantially flat, a base 18, two end walls 20 and a rear wall 22. The exterior casing 12 has a generally oblong shape and in the front has a rectangular shaped open front. The top 16 has a protruding ledge 24 extending over the inner container 14 primarily to provide weather protection. The two end walls 20 have a curved lip 23 extending down from the protruding ledge 24 and then sloped edges 25 extending down to the base 18. Thus, the width of the base 18 and the width of the top 16, including the ledge 24, are substantially the same.

On the top 16 are four substantially parallel bevel shaped grooves 26 extending from front to back and on the base 18 are four mating bevel ridges 28, also extending from front to back. The mating ridges 28 on the base 18 of an exterior casing 12 slide into the bevel grooves 26 on the top 16 of another exterior casing 12, thus enabling mailboxes to be stacked one on top of the other and being locked together by the mating ridges 28 and grooves 26.

From the front of the mailbox 10 the left end wall 20 has a bevel shaped groove 30 extending from front to back positioned just below the curved lip 23 and on the right end wall 20 is a bevel shaped ridge 32 extending from front to back and at the same level as the groove 30 on the left end wall 20. The ridge 32 on the right end wall 20 of one exterior casing 12 engages in the groove 30 in the left end wall 20 of an adjacent exterior casing 12, thus permitting mailboxes to be assembled into a multiple unit, both vertically and horizontally.

A plurality of grooves 34 extending from the open front of the exterior casing 12 across the top 16 and down the rear wall 22 are provided for decorative purposes and also to drain any water that should rest thereon so that the top surface of the mailbox does not have water thereon. A mail entry flap 36 is positioned below the protruding ledge 24 of the top 16. The flap 36 has pivot positions 38 on the inside of the two end walls 20 and extends down to an elevation substantially the same as the top edge of the inner container 14 when positioned within the exterior casing 12.

Figure 3:
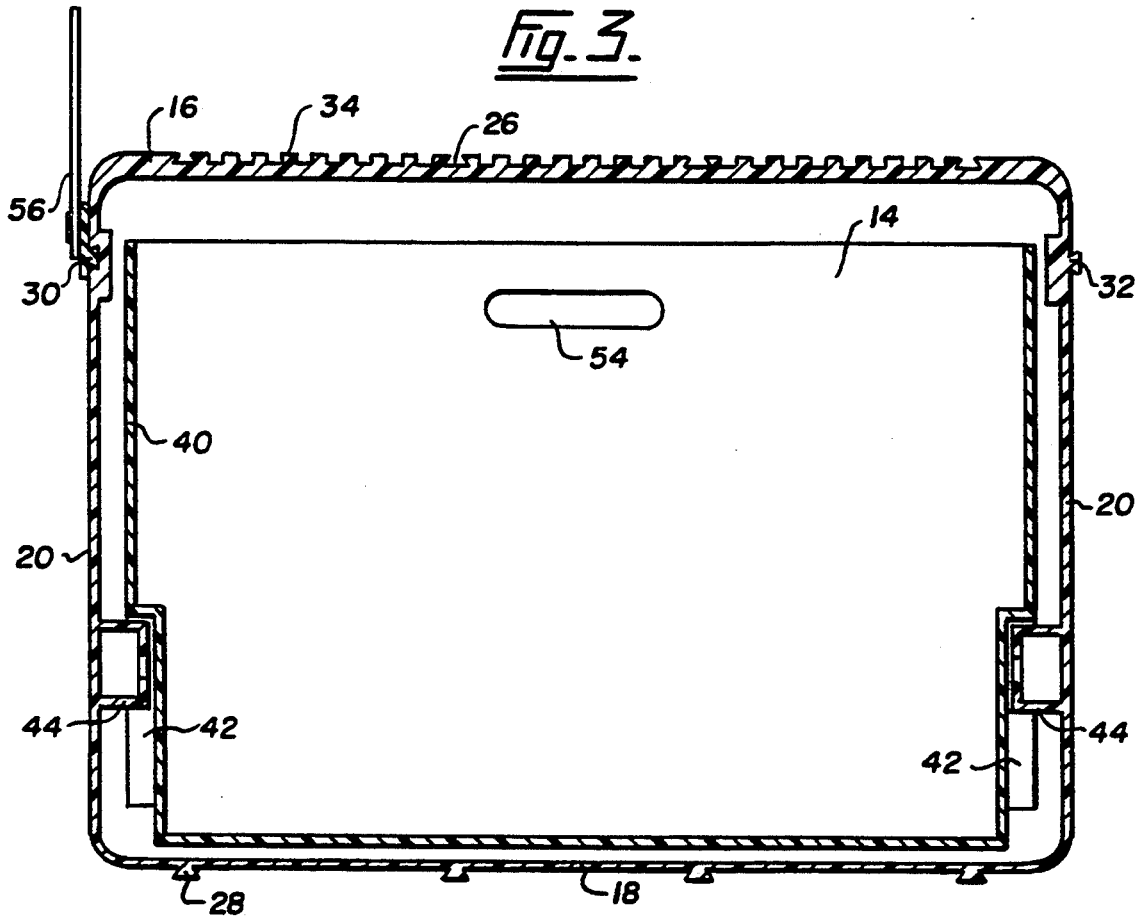
FIG. 3 is a longitudinal sectional view taken at line 3—3 of FIG. 2.
Figure 4:
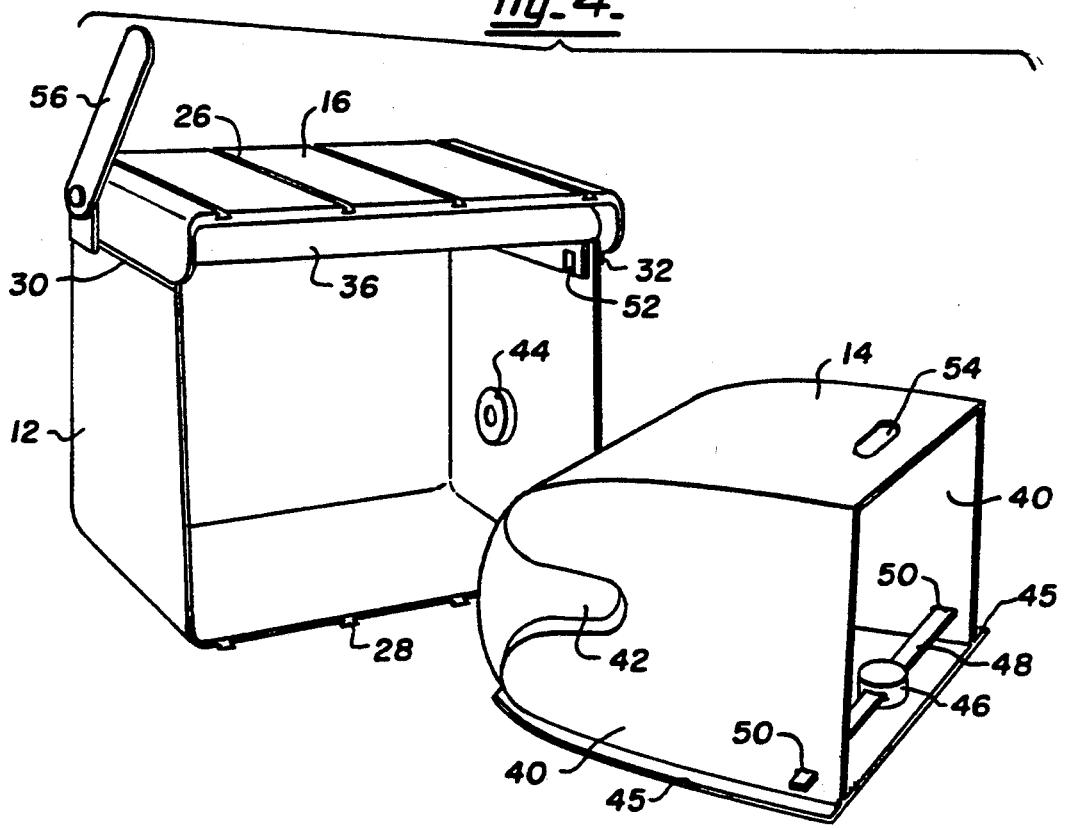
FIG. 4 is an isometric view of the plastic mailbox of FIG. 1 with the inner container separate from the exterior casing.

The inner casing 14 has a generally U-shaped cross-section with end walls 40 each having an upside down U-shaped inset 42 at the base, the U-shaped insets 42 fit over circular disc like protrusions 44 on the inside of the end walls 20 of the exterior casing 12. The U-shaped inserts 42 permit the inner container 14 to pivot about the protrusions 44 so that when the top of the inner container 14 pivots forwards and downwards, it may be lifted out from the exterior casing 12. In order to retain the inner container 14 in an upright position within the exterior casing 12, a key lock 46 is provided which engages two extendable metal arms 48 as illustrated in FIG. 4 which protrude out through apertures 50 cut in the ends 40 of the inner container 14 and engage in slots 52 provided on the inner walls 20 of the exterior casing 12. The arms 48 extend outwards to engage in the slots 52 and when the key is turned in the lock 46, the arms 48 disengage from the slots 52 allowing the inner container 14 to pivot forwards and downwards. A handle slot 54 is provided in the inner container 14 as shown in FIG. 3, so that it can be carried away from the exterior casing 12 with mail inside it. The inner casing 14 has lips 45 which extend beyond the end walls 40 so the surface of the casing 14 fills up almost the entire space in the open front of the exterior casing 12 to provide security and protection for the mailbox. The lips 45 cover up the metal arms 48 in the slots 52 to ensure they cannot be tampered with when the inner container 14 is locked in place.

A pivotable flag 56 is provided to engage in the groove 30 on the left end wall 20. The flag 56 may be raised to indicate the presence of mail in the mailbox, and can be lowered when the mail is removed. The flag 56 cannot be used when mailboxes are joined together into a multiple unit except at the end walls 20 of the exterior casings 12 which have open bevel grooves 30 available for a flag 56.

Figure 5:
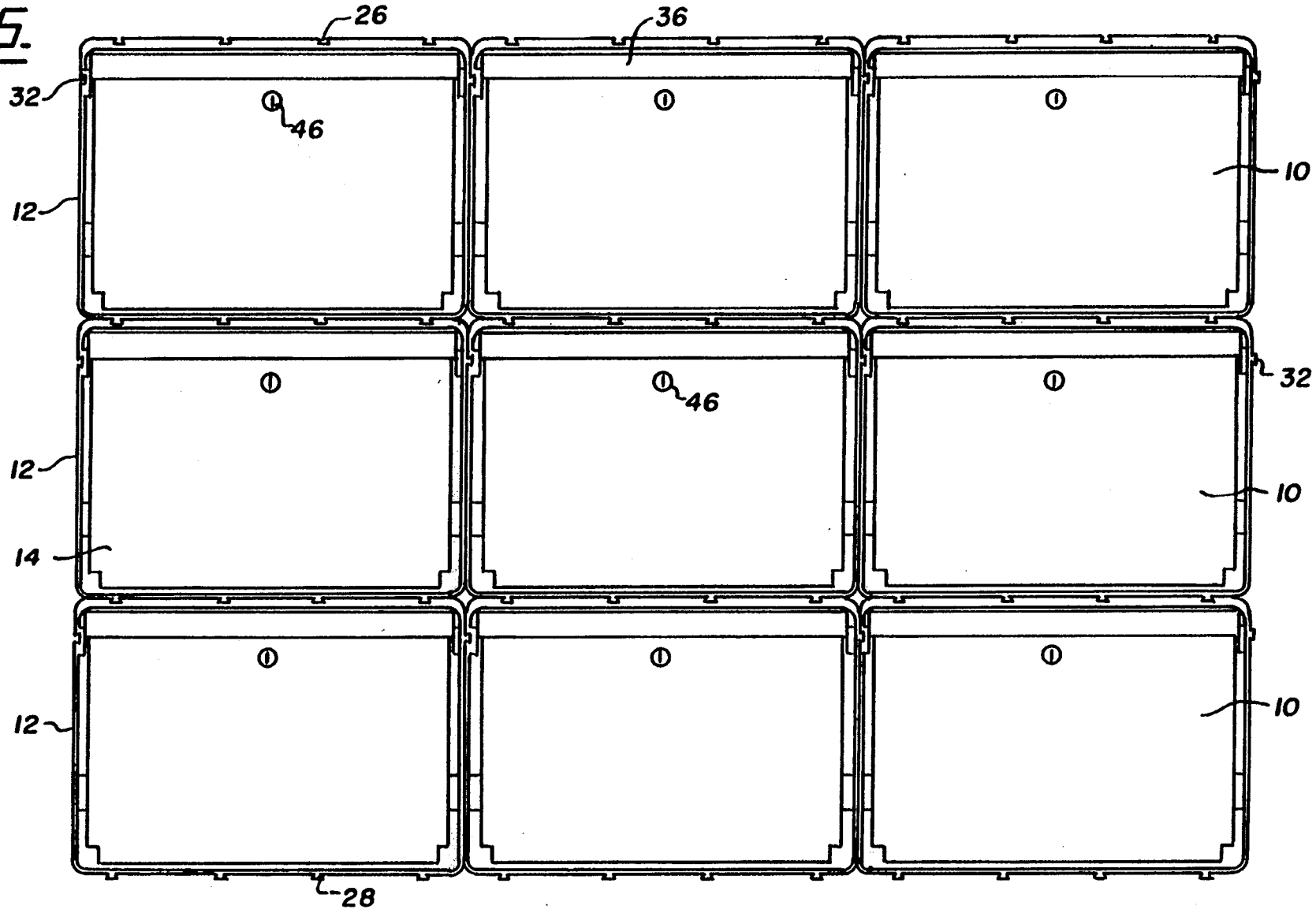
FIG. 5 is a front elevational view showing mailboxes joined together into a multiple unit.

FIG. 5 illustrates a multiple unit of nine plastic mailboxes. When in use the mail may be inserted through the flaps 36 and falls down into the inner container 14. The flaps 36 are not big enough to allow the mail to be tampered with or removed. The flaps 36 also prevent rain and snow from being blown into the inner container 14. The mail may then be recovered from each mailbox by unlocking the mailbox at lock 46, pivoting the inner container 14 forwards and downwards to either remove the mail from therein or, if there is a lot of mail, take the inner container 14 by the handle slot 54 and carry it to a suitable place where it can be emptied. The inner container 14 is then be replaced into the exterior casing 12 and locked in place for the next mail delivery.

The mailboxes can be used individually, in which case a pivotable flag 56 can be provided for each one, or as a multiple unit as shown in FIG. 5. Whereas nine mailboxes 10 are shown in FIG. 5, more mailboxes 10 may be attached at the top, base or end walls, or one or more mailboxes may be removed. Thus the exact number of mailboxes 10 for a unit can be adjusted to the number of users.

There is a requirement for a mailbox to have two separate opening mechanisms, in other words two separate locks, so that a mailman or delivery person can deliver mail to a mailbox by opening the box. It is generally a requirement by most Post Offices that a mailman has one key suitable for opening many separate boxes otherwise many different keys would have to be carried making the mailman's job difficult, a) because he has to remember which key fits which mailbox, and b) because he has to carry a large quantity of keys.

Figure 6:
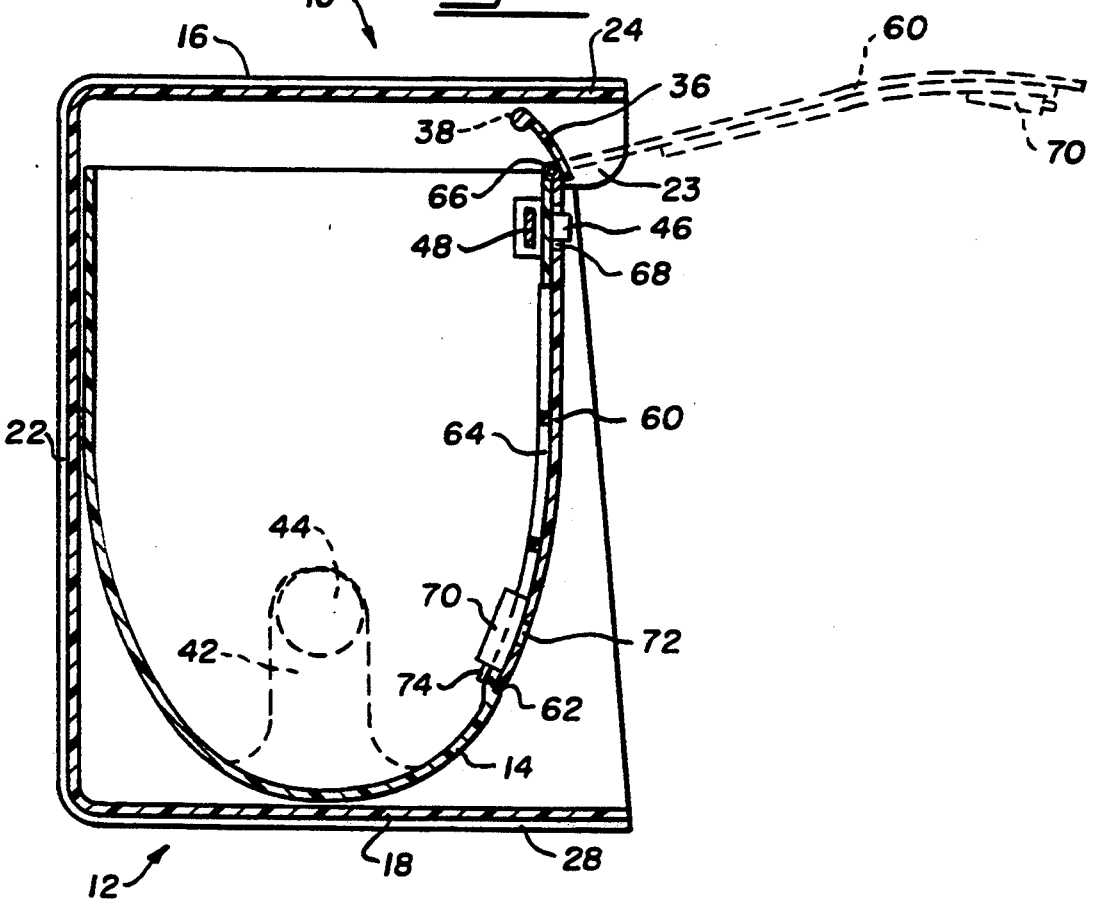
FIG. 6 is a cross-sectional view through another embodiment of a mailbox showing a separate front panel for a mailman or delivery person to deliver mail.
Figure 7:
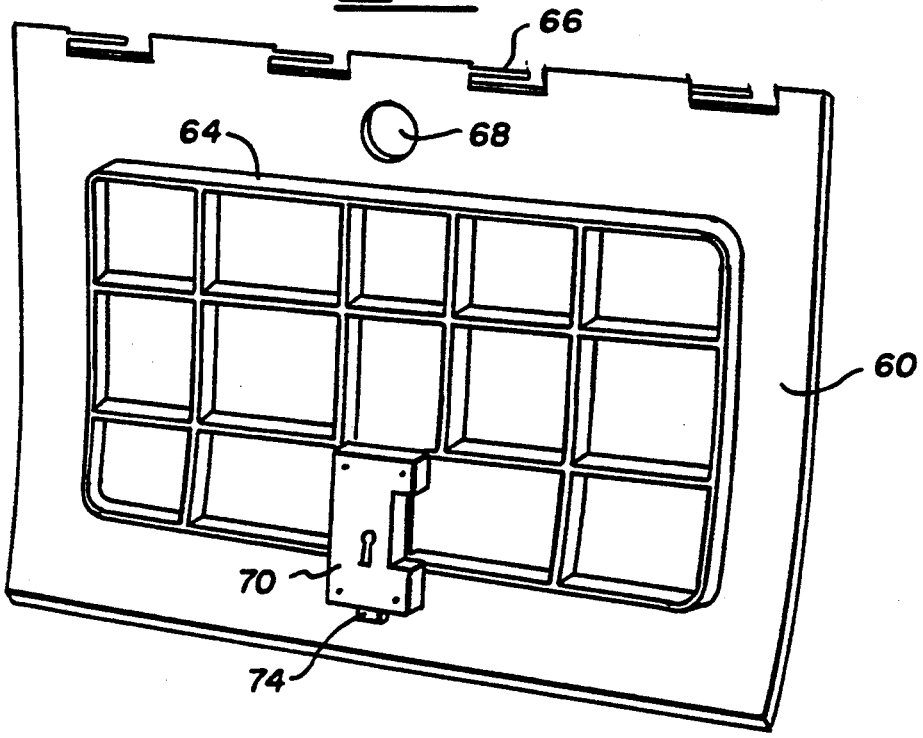
FIG. 7 is an isometric view of the front panel for the mailbox shown in FIG. 6.

Another embodiment of the mailbox according to the present invention is shown in FIGS. 6 and 7. In this embodiment a separate front panel 60 fits into an aperture 62 in the front of the inner container 14. The front panel 60 fits over the surface of the inner container, and has reinforced interior ribs 64 that fit within the aperture 62 in the inner container 14 and provide additional strength to the front panel 60. Hinges 66 are provided at the top of the front panel 60 where it joins to the top front edge of the inner container 14. As shown in FIG. 6, the front panel 60 swings up and open leaving the aperture 62 free for insertion of mail and the like.

A hole 68 is provided in the front panel 60 above the ribs 64 to fit directly over the lock 46. Thus, when the front panel is closed, the lock 46 is not interfered with and the mailbox owner can operate the lock 46 and pivot the inner container 14 forward in the normal manner. A second lock 70 is shown positioned at the bottom of the front panel 60. This lock has an access hole 72 for a key from the outside of the mailbox and has a bolt 74 which engages the inside of the inner container 14 to prevent the front panel 60 from being opened.

The second lock 70 is made to have one key for many locks, thus a mailman or delivery person is able to open any number of front panels 60 of different mailboxes, either assembled together as shown in FIG. 5 or mounted separately, with only one key. The mailbox owners each have their own individual keys which open only their own mailbox. These keys open the lock 46 thus permitting the inner container 14 to be tipped forward for emptying, or being taken away for emptying. The front panel 60 need only be opened for placing large pieces of mail or parcels into a mailbox, otherwise letters can be inserted through the flap 36 without having to unlock either of the locks 46,70.

The front panel 60 when locked into the aperture 62 remains a part of the inner container 14 and can only be opened by the delivery person who has the correct key.

The materials of construction are preferably molded plastic such as polypropylene. Different colors may be provided as desired. The mailbox comes in two definite parts which separate. The exterior casing is formed of one molding except for the flap 36, as is the inner container 14, except for the locking mechanism. When the front panel 60 is installed, this too is a separate component but remains hinged to the inner container 14.

Various changes may be made to the embodiments shown herein without departing from the scope of the present invention which is limited only by the following claims. For example, the lock mechanism may be replaced by a simple handle if a lock is not required. The shape of the mailbox is designed to combine with other mailboxes into a multiple unit. Attachments may be made for example at the rear wall of the exterior casing to a back support to prevent the mailboxes from being removed.

The embodiments of the present invention in which an exclusive property or privilege is claimed are defined as follows:

1. A plastic mailbox comprising in combination an exterior casing, substantially oblong in shape, having a top, a base, two end walls and a rear wall, the casing having a substantially rectangular shaped open front, connection means on the top, on the base and on the end walls for connection to an adjacent mailbox;

an inner container fitting within the exterior casing, the inner container pivotable about internal protrusions from the end walls of the casing, and removable from the casing, and locking means to retain the inner container in an upright position within the exterior casing.

2. The plastic mailbox according to claim 1 wherein the top has a protruding ledge extending over the open front.

3. The plastic mailbox according to claim 1 including a mail entry flap positioned below the top of the exterior casing in the open front, pivotable to provide a slot for inserting mail when the inner container is retained within the exterior casing.

4. The plastic mailbox according to claim 1 wherein the connection means on the top, and on the base of the exterior casing includes at least one bevel groove on the exterior surface of the top extending from the open front to the rear wall and at least one mating bevel ridge on the exterior surface of the base extending from the open front to the rear wall, the bevel ridge on one mailbox to mate with the bevel groove of an adjacent underneath mailbox to join the mailboxes together.

5. The plastic mailbox according to claim 4 wherein the connection means on the two end walls of the exterior casing includes at least one bevel groove on one end wall extending from the open front to the rear wall and at least one mating bevel ridge on the other end wall extending from the open front to the rear wall, the bevel groove on one mailbox to mate with the bevel ridge of an adjacent side by side mailbox to join the mailboxes together.

6. The plastic mailbox according to claim 5 including a pivotable flag means engageable in the bevel groove on one end wall pivotable between an up and down position, to indicate when the mailbox has mail therein.

7. The plastic mailbox according to claim 1 wherein the locking means to retain the inner container in an upright position within the exterior casing comprises a key lock in front of the inner container operating extendable arms inside the inner container to engage slots on the interiors of the end walls of the exterior casing and retain the inner container in an upright position within the exterior casing.

8. The plastic mailbox according to claim 1 wherein the inner container and the exterior casing are each integrally molded of durable plastic material.

9. The plastic mailbox according to claim 1 wherein the exterior surface of the top and rear wall of the exterior casing have a plurality of grooves extending from the open front across the top and down the rear wall to the base.

10. The plastic mailbox according to claim 1 including a front panel hinged to a front edge of the inner container, and covering an aperture in the front of the inner container, the front panel adapted to open and close independent of the locking means to retain the inner container within the exterior casing.

11. The plastic mailbox according to claim 10 wherein the front panel having a separate locking means to lock the front panel closed to the inner container.

12. The plastic mailbox according to claim 11 wherein the locking means to retain the inner container within the exterior casing comprises a first key lock in front of the inner container operating extendable arms inside the inner container to engage slots on the interiors of the end walls of the exterior casing, and the separate locking means to lock the front panel closed to the inner container comprises a second key lock, the first key lock and the second key lock having different operating keys.

* * * * *